US007350647B2

(12) United States Patent
Haller et al.

(10) Patent No.: US 7,350,647 B2
(45) Date of Patent: Apr. 1, 2008

(54) BOTTLE RACK AND A BOTTLE STORAGE DEVICE

(75) Inventors: Erna Haller, Edelbeuren (DE); Martin Goeppel, Erienmoos (DE)

(73) Assignee: Liebherr-Hausgeraete Ochsenhausen GmbH, Ochsenhausen (DE)

( * ) Notice: Subject to any disclaimer, the term of this patent is extended or adjusted under 35 U.S.C. 154(b) by 143 days.

(21) Appl. No.: 11/044,243

(22) Filed: Jan. 27, 2005

(65) Prior Publication Data

US 2005/0211648 A1 Sep. 29, 2005

(30) Foreign Application Priority Data

Jan. 28, 2004 (DE) ..... 20 2004 001 240

(51) Int. Cl.
*A47B 73/00* (2006.01)

(52) U.S. Cl. ..... 211/75

(58) Field of Classification Search ..... 211/74, 211/75, 85.29, 151, 126.15; 312/322, 323
See application file for complete search history.

(56) References Cited

U.S. PATENT DOCUMENTS

| | | | | |
|---|---|---|---|---|
| 321,078 | A * | 6/1885 | Birkhead | 312/298 |
| 1,015,722 | A * | 1/1912 | Bezold | 312/303 |
| 2,839,349 | A * | 6/1958 | Culver | 312/323 |
| 3,722,975 | A * | 3/1973 | Taylor | 312/334.44 |
| 3,975,071 | A * | 8/1976 | Quinn | 312/323 |
| 4,314,734 | A * | 2/1982 | Grunert | 312/322 |
| 4,441,771 | A * | 4/1984 | Roesler | 312/322 |
| 5,215,364 | A * | 6/1993 | Moore | 312/323 |
| 5,242,219 | A * | 9/1993 | Tomaka | 312/245 |
| 5,244,272 | A * | 9/1993 | Thompson | 312/334.23 |
| 5,348,207 | A * | 9/1994 | Frank | 224/310 |
| 5,944,201 | A * | 8/1999 | Babboni et al. | 211/151 |
| 5,957,558 | A * | 9/1999 | Quade | 312/323 |
| 6,039,422 | A | 3/2000 | Butters et al. | |
| 6,357,607 | B1 * | 3/2002 | Wu | 211/85.29 |
| 7,063,219 | B2 * | 6/2006 | Fann et al. | 211/74 |
| 7,090,316 | B2 * | 8/2006 | Model | 312/323 |

FOREIGN PATENT DOCUMENTS

| | | |
|---|---|---|
| DE | 1290 688 | 3/1969 |
| DE | 29900609 | 5/1999 |

OTHER PUBLICATIONS

Patent Abstracts of Japan BD 2003, NR 4, Apr. 2, 2003 & JP2002-350025, Dec. 4, 2002.

* cited by examiner

*Primary Examiner*—Jennifer E. Novosad
(74) *Attorney, Agent, or Firm*—Dilworth & Barrese LLP

(57) ABSTRACT

A bottle rack is provided with a plurality of receivers for storage of bottles in prone position. A certain number of the receivers are foldable to be angularly tilted with respect to the non-foldable receivers and to receive respective bottles in sloping position.

13 Claims, 2 Drawing Sheets

BOTTLE RACK AND A BOTTLE STORAGE DEVICE

The invention relates to a bottle rack having a width B and a length L and a number N of receivers arranged next to one another in the direction of the width B for the lying storage of bottles in an alignment parallel to the length L. The invention furthermore relates to a bottle storage device, a wine storage cabinet and a cooler cabinet having at least one such bottle rack.

BACKGROUND OF THE INVENTION

Bottle racks are used e.g. in wine storage cabinets, cooler cabinets for beverages or bottle shelves. They are either provided in a fixed mounting or as an insert in such cabinets or shelves. They can, however, also be an integral component of such a cabinet or shelf. The bottles are stored in lying manner next to one another on the bottle racks. The bottles are as a rule placed into receivers which prevent a rolling in the lateral direction. In this way, a plurality of layers of bottles can be stored on a plurality of bottle racks lying above one another. Equally, a plurality of bottle layers can be put in layers above one another on one bottle rack.

An identification of the individual stored bottles is difficult due to the bottles being arranged, optionally, on top of one another. A presentation of the bottle, e.g. of the label, is also not possible with a lying storage. Solutions have therefore been proposed in which the bottle rack can be brought into a forwardly inclined sloping position. At least the front part of the bottle rack is brought downwardly completely into a sloping position in this process so that all receivers permit the presentation of bottles in a semi-upright position on this bottle rack. The bottles can be received and presented in a semi-upright position on such an inclined bottle rack.

A plurality of bottles cannot be stored over one another on a bottle rack brought into a sloping position in the manner described. The receiving capacity is already reduced in this manner. In addition, a bottle rack which has been folded down may well prevent the filling of a bottle rack lying beneath it so that the capacity of a corresponding bottle storage device is further reduced.

SUMMARY OF THE INVENTION

It is the object of the present invention to provide a bottle rack and a bottle storage device which, on the one hand, permit a presentation of stored bottles and nevertheless ensure sufficient capacity.

This object is solved by a bottle rack and storage device having the features herein. Advantageous aspects form the subject of the invention herein. A wine storage device or a cooler cabinet comprising bottle racks or having a bottle storage device are also provided in accordance with the invention.

In a bottle rack in accordance with the invention, a number $N_1$ of the receivers for the lying storage is designed to be foldable such that some of these foldable receivers having a length $L_1$ which is smaller than or equal to the total length L of the bottle storage rack can be brought into an angular position to the non-folded receivers and bottles can be received in a sloping position.

With the bottle rack in accordance with the invention, some of the bottles can still be placed in several layers on top of one another, as required, in lying storage. Only some of the receivers can be folded down into a sloping position so that a sloping storage of bottles is possible on said some of the receivers. In this way, a single bottle or some few bottles can e.g. be introduced in a sloping upright position so that the label can be recognized. Next to these, on the part of the rack remaining in the fully horizontal position, bottles can still be stacked on top of one another, in multiple layers as required, in lying storage. For example, the bottles stored in a semi-upright position can serve for the presentation of the label of a wine which is stored in a lying manner in a plurality of bottles in the corresponding bottle rack. The bottle rack in accordance with the invention also permits the storage of open bottles by the sloping upright storage possibility.

The receivers can e.g. be formed by strips, e.g. wooden strips, arranged in parallel which have a spacing from one another which is smaller than a normal bottle.

The part of the bottle rack which can be folded down includes a width which is smaller than the total width of the bottle rack. It can be disposed in any position of the bottle rack. Advantageously, however, a side part of the bottle rack is designed to be downwardly foldable in the manner in accordance with the invention so that only a simple partition of the bottle rack is necessary.

The number of receivers which can be folded down can be any number less than the total number of the receivers of the bottle rack. The design of half the total number of receivers in a downwardly foldable manner is e.g. possible. To present e.g. an individual bottle, which is representative for the content of the whole bottle rack, a low number of receivers are advantageously designed in a downwardly foldable manner, e.g. only one or two receivers.

The invention can be realized with a bottle rack in which the downwardly foldable receivers can be brought downwardly into a sloping position over its total length along the bottle alignment. A space-saving storage of bottles is also possible in the sloping position if only part of the length can be downwardly folded into a sloping position in the bottle direction.

The bottles placed into the folded down receivers can be held in different manners. For example, the receivers can have corresponding abutments. A design is particularly simple in which a transverse strip, against which the slopingly inserted bottles can be supported at their bases, is provided in the front region of at least that part of the bottle rack which can be folded down.

In an advantageous further development, a latching apparatus is provided which permits a fixing of the downwardly foldable part in the non-folded down position. Such a latching apparatus can e.g. comprise a spigot which can be displaced into the downwardly foldable part from the part of the bottle rack not folded down in order to fix the two parts against one another. In another embodiment, a spigot is pushed into the part not downwardly foldable from the downwardly foldable part. In an advantageous embodiment, the displaceable spigot is disposed in the transverse strip in the front region of the bottle rack.

The bottle racks can be part of a shelf or of a cabinet and can be fixedly mounted or made in integral form there. A design is particularly flexible in which the bottle racks can be pushed into a shelf or a storage cabinet into corresponding support grooves and have corresponding insertion devices for this purpose. In such a preferable aspect, a support spigot can be provided in a further development which is attached to the downwardly foldable part of the bottle rack such that it engages into a lower-lying support groove in the downwardly folded state in order thus to support the downwardly folded part. In an analog manner, the support spigot can be designed to lie on a support rib if the individual racks lie on support ribs.

A setting of the angle between the downwardly folded parts and the parts not downwardly folded is, for example, possible with the last-named embodiments by a selection of the groove into which the support spigot is introduced or by a selection of the support rib onto which the support spigot is placed.

Additionally or alternatively to this fixing of the downwardly folded part of the bottle rack, provision can e.g. be made for a central strip to be provided beneath the folding axis which has a surface chamfered in such a manner that the downwardly folded part can be supported against this chamfered surface.

The bottle rack in accordance with the invention can advantageously be provided in a bottle storage device such as a bottle shelf or a bottle cabinet. Such a bottle cabinet can e.g. have a glass front which permits the presentation of individual bottles on the downwardly folded part of a bottle rack. All bottle racks of the bottle storage device can be made downwardly foldable or e.g. only one in order to be able to present the content of the cabinet by way of example on the downwardly folded part. The bottle storage device can be fitted with fixedly mounted bottle racks or integrally formed bottle racks or with grooves into which corresponding bottle racks can be inserted or include support ribs onto which corresponding bottle racks can be placed.

The bottle storage device can be designed as a wine storage apparatus. Both a bottle storage device and a wine storage apparatus in accordance with the invention can be made as a cooler cabinet to permit a temperature control of the bottles put in.

BRIEF DESCRIPTION OF THE DRAWINGS

The invention will be explained in detail with reference to the enclosed Figures. There are shown.

DESCRIPTION OF THE PREFERRED EMBODIMENTS

Figure 1:
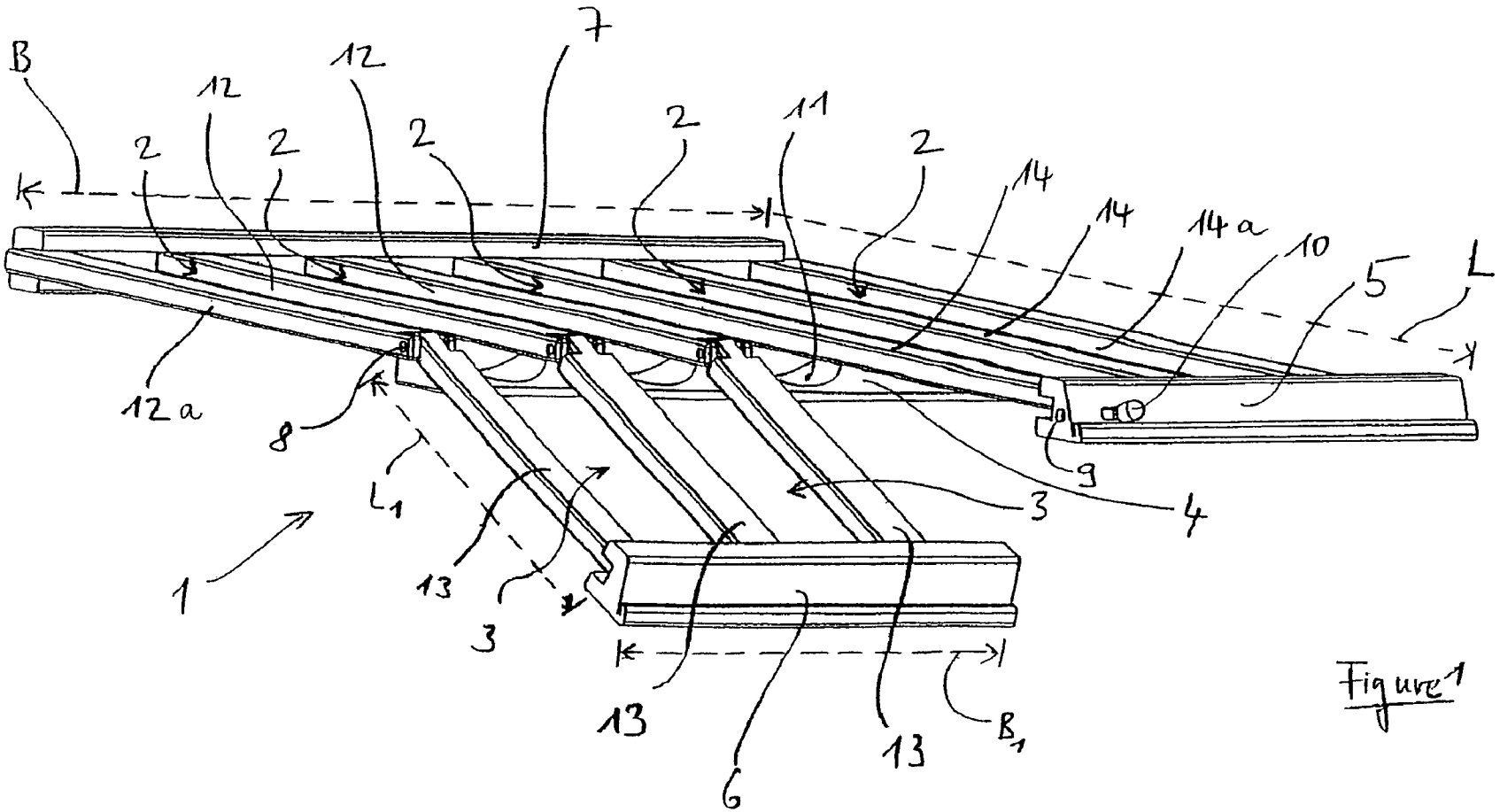
FIG. 1: a perspective view of a bottle rack in accordance with the invention.

FIG. 1 shows a bottle rack in accordance with the invention of the width B and the length L. In the embodiment shown, the bottle rack consists of a number of strips 12, 14 arranged next to one another and at a distance from one another in parallel such that they can receive commercial bottles in an alignment along the length L and such that they serve the storage of said bottles. These receivers are designated by 2 in FIG. 1. In the right hand region of FIG. 1, the strips 14 are through going over the total length L. In the left hand region of FIG. 1, the strips are divided and each include a part 13 which can be folded down. In the downwardly folded state shown, partly downwardly folded receivers 3 are created in this manner. The strips 12, 14 are connected to one another in the rear region by a strip 7 aligned in the width direction. In the front region, the continuous strips 14 arranged at the right in FIG. 1 are connected to one another by a transverse strip 5. The downwardly foldable parts 13 of the receivers arranged on the left in the Figure are connected to one another by the transverse strip 6. The transverse strip 6 has a width extent $B_1$, while the downwardly foldable parts of the receivers arranged on the left in FIG. 1 have the length $L_1$.

The divided strips 12, 13 are folded downwardly about an axis 8. A central strip 4 is disposed below the axis 8 and is designed to slope forwardly at least in the region of the downwardly foldable strips 12, 13 so that the downwardly folded strips 13 can be supported against the central strip 4.

In the embodiment shown, a latching device 9, 10 is provided. A spigot can be pushed out of the opening 9 by a sliding lever 10 and can engage into an opening (not visible in FIG. 1) of the downwardly folded transverse strip 6 when the latter is in the state not downwardly folded. In this manner, the right hand part not downwardly foldable and the downwardly foldable left hand part in FIG. 1 can be fixed against one another to provide a bottle rack which can serve in a conventional manner the storage of lying bottles next to one another over its total width.

The bottle rack shown in FIG. 1 can be made e.g. of wood; the displaceable spigot for fixing e.g. of brass.

Figure 2:
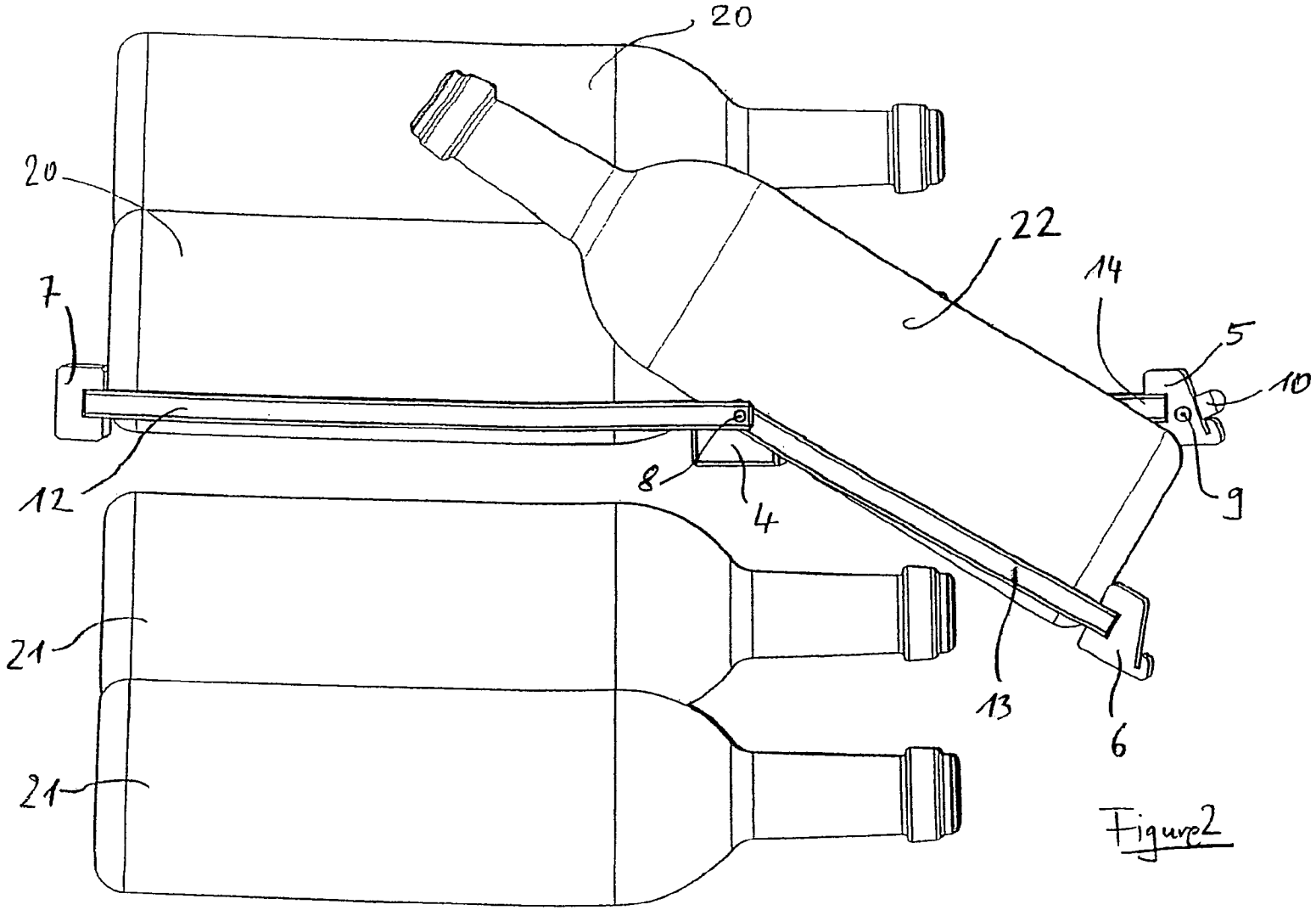
FIG. 2: a bottle rack in accordance with the invention in a schematic representation in use.

FIG. 2 shows a bottle rack 1 in accordance with the invention in use in a schematic representation. The front part of the bottle rack, which can be recognized at the right in FIG. 2, is downwardly folded into a sloping position. The downwardly folded strips 13 are supported against the central strip 4. A bottle 22 is positioned in a semi-upright position on the downwardly folded part and is supported at its bottom against the transverse strip 6. A plurality of bottles are put in layers, partly on top of one another, in the right hand part of the bottle rack 1, which is at the rear in FIG. 2.

It is only schematically indicated that further bottles are stored beneath the bottle rack 1, e.g. on bottle racks in accordance with the invention, with these further bottle racks not being shown in FIG. 2.

In FIG. 2, the bottle 2 can, for example, be arranged with its label facing forward such that it is visible through a glass front of a bottle cabinet. If the bottles 20 stored in a lying manner are identical to the semi-upright positioned bottle 22 on the bottle rack, the bottle 22 stored semi-upright serves the identification of the rack contents. An individual bottle 22 stored semi-upright can equally be representative of the contents of the total bottle storage device with the plurality of bottle racks. Despite the sloping storage of the individual bottle 22 or of some few bottles 22, the storage capacity is not too limited, since a lying storage of the bottles 20 is still possible, optionally in a plurality of layers, in the part of the bottle rack 1 not downwardly folded.

Finally, it is possible to store an open bottle in a semi-upright position on the bottle rack 1 in accordance with the invention.

A bottle rack 1 in accordance with the invention can be designed for insertion into a bottle shelf or corresponding grooves or for placing onto support ribs in a bottle cabinet or bottle shelf. In the embodiment shown in FIG. 1, the laterally outwardly arranged strips 12*a* and 14*a* are designed to project slightly and can thus be inserted into or placed onto a corresponding holder.

In an embodiment which is not shown, the downwardly foldable part has an outwardly directed spigot which can likewise be pushed into a corresponding groove or onto a corresponding rib which is arranged lower than that groove or that rib into which the strip 12*a* is inserted or onto which it is placed. The downwardly folded part can be fixed ideally in the desired position with such a spigot. In such an aspect, the central strip 4 need not serve the support of the downwardly folded part. By selection of the groove or of the rib into which the spigot of the downwardly folded part is inserted or onto which the spigot of the downwardly folded part is placed, the angular position of the downwardly folded part can be selected.

The bottle rack in accordance with the invention is suitable for use in bottle storage devices, e.g. bottle cabinets, wine storage cabinets, wine coolers or similar.

The invention claimed is:

1. A bottle rack comprising a width (B) and length (L), a number (N) of receivers (2) each extending parallel to the length (L) and arranged adjacent one another in the direction of the width (B) for receiving and storing bottles (20) in alignment parallel to the length (L), wherein a number ($N-N_1$) of the adjacently-arranged receivers (2) are stationary and a number ($N_1$) of the adjacently-arranged receivers (2) each comprise a pivotal portion (3) having a length (L1>L) less than length (L) of the bottle rack (1) and are pivotal to a downward angular position relative to the adjacent, stationary receivers (2), such that bottles (22) supported upon said respective pivotal portions (3) are presented in sloping position, additionally comprising a latching device (9, 10) arranged to fix the downwardly pivotal portions and stationary receivers (2, 3) to one another without downward pivoting of the pivotal portions (3), and wherein the latching device comprises a displaceable fixing spigot which can be displaced from either a stationary part into a downwardly pivotal part of the bottle rack (1) or from the downwardly pivotal part into the stationary part of the bottle rack (1).

2. A bottle rack in accordance with claim 1, wherein the number ($N_1$) of the adjacently-arranged receivers (2) each having the pivotal portion (3) is one-half total number of the adjacently-arranged receivers (2) of the bottle rack (1).

3. A bottle rack in accordance with claim 1, wherein the number ($N_1$) of the receivers (2) each having the pivotal portion (3) is 1.

4. A bottle rack in accordance with claim 1, comprising transverse strip (6) which includes the downwardly pivotal portions (3) of the receivers (2), wherein the transverse strip (6) is arranged in a front region of the bottle rack (1) to support the sloping bottles (22).

5. A bottle rack in accordance with claim 1, wherein the pivotal part includes, in an outer region, at least one support spigot which is positioned for insertion into a support groove or for placing onto a support rib which is arranged lower than a support groove or rib in or on which the stationary part of the bottle rack (1) is supported.

6. A bottle storage device comprising at least one bottle rack (1) in accordance with claim 1.

7. A wine storage apparatus comprising at least one bottle storage device in accordance with claim 6.

8. A cooler cabinet comprising at least one bottle rack in accordance with claim 1.

9. A bottle rack in accordance with claim 1, wherein each said receiver (2) comprising the pivotal portion (3) also comprises a stationary portion (2), and an axis (8) positioned thereon and extending in the width direction (B), such that the pivotal portion (3) is directly mounted upon the adjacent stationary portion (2) to pivot about the axis (8).

10. A bottle rack, comprising a width (B) and length (L), a number (N) of receivers (2) each extending parallel to the length (L) and arranged adjacent one another in the direction of the width (B) for receiving and storing bottles (20) in alignment parallel to the length (L), wherein a number ($N-N_1$) of the adjacently-arranged receivers (2) are stationary and a number ($N_1$) of adjacently-arranged receivers (2) each comprise a pivotal portion (3) having a length (L1>L) less than length (L) of the bottle rack and are pivotal to a downward angular position relative to the adjacent, stationary receivers (2), such that bottles (22) supported upon said respective pivotal portions (3) are presented in sloping position, a separately-mounted central strip (4) upon the bottle rack (1) extending beneath a pivoting axis (8) of a downwardly pivotal part of the bottle rack (1), both the separately-mounted central strip (4) and pivoting axis (8) extending in the width direction (B), and the central strip (4) being chamfered such that the downwardly pivoted portions (3) of the receivers (2) are supported against the central strip (4) in the sloping position.

11. A bottle rack in accordance with claim 10, comprising a latching device (9, 10) arranged to fix the downwardly pivotal portions and stationary receivers (2, 3) to one another without downward pivoting of the pivotal portions (3).

12. A bottle rack, comprising a width (B) and length (L), a number (N) of receivers (2) each extending parallel to the length (L) and arranged adjacent one another in the direction of the width (B) for receiving and storing bottles (20) in alignment parallel to the length (L), wherein a number ($N-N_1$) of the adjacently-arranged receivers (2) are stationary and a number ($N_1$) of adjacently-arranged receivers (2) each comprise a pivotal portion (3) having a length (L1>L) less than length (L) of the bottle rack and are pivotal to a downward angular position relative to the adjacent, stationary receivers (2), such that bottles (22) supported upon said respective pivotal portions (3) are presented in sloping position, each said receiver (2) comprising the pivotal portion (3) also comprises a stationary portion (2), and an axis (8) positioned thereon and extending in the width direction (B) such that the pivotal portion (3) is directly mounted upon the adjacent stationary portion (2) to pivot about the axis (8), a separately-mounted central strip (4) upon the bottle rack (1) extending beneath the pivoting axis (8) of a downwardly pivotal part (3) of the bottle rack (1) and extending in the width direction (B), and the central strip (4) being chamfered such that the downwardly pivoted portions (3) of the receivers (2) are supported against the central strip (4) in the sloping position.

13. A bottle rack in accordance with claim 12, comprising a latching device (9, 10) arranged to fix the downwardly pivotal portions and stationary receivers (2, 3) to one another without downward pivoting of the pivotal portions (3).

* * * * *